US010556332B2

(12) United States Patent
Blessing

(10) Patent No.: US 10,556,332 B2
(45) Date of Patent: Feb. 11, 2020

(54) DRIVING DEVICE

(71) Applicant: Hilti Aktiengesellschaft, Schaan (LI)

(72) Inventor: Matthias Blessing, Frastanz (AT)

(73) Assignee: HILTI AKTIENGESELLSCHAFT, Schaan (LI)

( * ) Notice: Subject to any disclaimer, the term of this patent is extended or adjusted under 35 U.S.C. 154(b) by 599 days.

(21) Appl. No.: 15/104,345

(22) PCT Filed: Dec. 16, 2014

(86) PCT No.: PCT/EP2014/077886
§ 371 (c)(1),
(2) Date: Jun. 14, 2016

(87) PCT Pub. No.: WO2015/091431
PCT Pub. Date: Jun. 25, 2015

(65) Prior Publication Data

US 2016/0311096 A1 Oct. 27, 2016

(30) Foreign Application Priority Data

Dec. 18, 2013 (EP) ..... 13198042

(51) Int. Cl.
*B25C 1/14* (2006.01)

(52) U.S. Cl.
CPC ..... *B25C 1/143* (2013.01)

(58) Field of Classification Search
CPC .. B25C 1/143; B25C 1/10; B25C 1/08; B25C 1/082; B25C 1/14; A22B 3/02
(Continued)

(56) References Cited

U.S. PATENT DOCUMENTS 3,786,977 A * 1/1974 Shamaly ..... B25C 1/143 227/10
3,899,113 A * 8/1975 Brack ..... B25C 1/18 227/10
(Continued)

FOREIGN PATENT DOCUMENTS

DE 195 08 699 A1 9/1995
DE 101 61 354 A1 6/2003
(Continued)

OTHER PUBLICATIONS

International Bureau, International Search Report in International Patent Application No. PCT/EP2014/077886, dated Mar. 16, 2015.
(Continued)

*Primary Examiner* — Nathaniel C Chukwurah
*Assistant Examiner* — Lucas E. A. Palmer
(74) *Attorney, Agent, or Firm* — Leydig Voit & Mayer, Ltd.

(57) ABSTRACT

The invention relates to a driving device comprising a hand-held housing in which there is accommodated a piston member for transmitting energy to a fastening element to be driven in, an interchangeable propellant and a combustion chamber arranged between the propellant and the piston member, said combustion chamber extending preferably about a central axis (A), and an actuator by means of which the energy that is transmissible from the propellant to the piston member is variable in a settable manner, wherein a discharge channel connected to the combustion chamber can be opened by means of a movable slide of the actuator, wherein a starting position of the piston member is variable in a settable manner by means of a second actuator.

19 Claims, 4 Drawing Sheets

(58) Field of Classification Search
USPC ..... 227/10
See application file for complete search history.

(56) References Cited

U.S. PATENT DOCUMENTS 3,973,708 A * 8/1976 Scotoni ..... B25C 1/082 227/10
4,068,790 A * 1/1978 Osterle ..... B25C 1/18 227/8
4,153,192 A * 5/1979 Jochum ..... B25C 1/14 227/10
4,382,533 A * 5/1983 Buechel ..... B25C 1/082 227/10
4,534,500 A * 8/1985 Jochum ..... B25C 1/008 173/13
4,687,126 A * 8/1987 Brosius ..... B25C 1/143 173/206
4,877,171 A 10/1989 Almeras
4,883,212 A * 11/1989 Philipp ..... B25C 1/18 227/9
5,029,744 A * 7/1991 Pai ..... B25C 1/143 227/10
5,653,370 A * 8/1997 Bereiter ..... B25C 1/123 173/162.2
5,699,948 A * 12/1997 Lee ..... B25C 1/14 227/10
5,732,869 A * 3/1998 Hirtl ..... B25C 1/143 227/10
5,767,434 A * 6/1998 Hirtl ..... B25C 1/14 227/10
5,799,855 A * 9/1998 Veoukas ..... B25C 1/188 227/10
5,975,397 A * 11/1999 Van Erden ..... B25C 1/04 227/10
6,032,846 A * 3/2000 Clark ..... B25C 1/14 227/10
6,123,242 A * 9/2000 Kersten ..... B25C 1/14 173/212
6,161,745 A * 12/2000 Grazioli ..... B25C 1/18 227/10
6,321,968 B1 * 11/2001 Remerowski ..... B25C 1/18 227/10
7,308,997 B2 * 12/2007 Neumann ..... B25C 1/082 123/23
2003/0015088 A1 * 1/2003 Wursch ..... B25C 1/143 89/1.14
2004/0182907 A1 * 9/2004 Dittrich ..... B25C 1/14 227/10
2010/0013137 A1 * 1/2010 Weller ..... B25B 1/10 269/218
2010/0258609 A1 * 10/2010 Lee ..... B25C 1/143 227/10
2012/0153003 A1 * 6/2012 Dittrich ..... B25C 1/08 227/10
2016/0311098 A1 * 10/2016 Blessing ..... B25C 1/143
2017/0266797 A1 * 9/2017 Lee ..... B25C 1/143

FOREIGN PATENT DOCUMENTS

DE 101 61 355 A1 6/2003
EP 0 330 950 A2 9/1989
EP 0 972 615 A2 1/2000
WO WO 2015/091113 A1 6/2015
WO WO 2015/091423 A1 6/2015

OTHER PUBLICATIONS

European Patent Office, European Search Report in European Patent Application No. 13198042.7, dated Jun. 12, 2014.

* cited by examiner

DRIVING DEVICE

CROSS-REFERENCE TO RELATED APPLICATIONS

This patent application is the U.S. National Stage of International Patent Application No. PCT/EP2014/077886, filed Dec. 16, 2014, which claims the benefit of European Patent Application No. 13198042.7, filed Dec. 18, 2013, which are each incorporated by reference.

The invention relates to a driving tool according to the preamble of Claim 1 and to a system for driving a fastening element into a workpiece according to the features of Claim 10.

BACKGROUND OF THE INVENTION

Handheld driving tools with propellant charges are known from the prior art, in which the combustion gases resulting after ignition of a pyrotechnic charge expand in a combustion chamber. Thereby a piston as an energy transfer means is accelerated and drives a fastener into a workpiece. The most optimized, residue-free and reproducible combustion of the charge possible is fundamentally desired. It must be taken into account in this regard that the charge generally includes particles such as powder grains, fibers or the like, which are initially driven ahead of a flame front upon ignition.

U.S. Pat. No. 6,321,968 B1 describes a driving tool having a propellant charge, in which the combustion chamber is separated by means of a perforated disk into an upper partial chamber and a lower partial chamber. Powder grains of the propellant charge are larger than the holes of the disk. Therefore the powder grains are initially accelerated in the central discharge region toward the perforated areas of the separating disk, where they are retained due to the dimensioning of the holes in the separating disk, so that the powder grains are primarily combusted in the upper partial chamber. FIG. 10 shows a variation in which a propellant charge is used without a cartridge. Due to the design of this variant, an ejection region enclosing the central axis and extending between the propellant charge and a central region of the separator disk cannot be provided in the upper partial chamber. The ejection region according to FIG. 10 therefore does not include the central axis of the combustion chamber but is instead arranged in a ring shape about a central plunger of the combustion chamber. The cartridge-free charge is ignited at an upper end of the central plunger.

U.S. Pat. No. 6,321,968 B1 also presents an adjustability of a dead space volume in order to adjustably modify the driving energy of the tool. A valve-like slide can be adjusted in a direction perpendicular to a driving axis for this purpose. Even in the closed position of the slide, the combustion chamber has a dead space, which is formed as a recess in a side wall of the combustion chamber.

The problem addressed by the invention is that of specifying a driving tool that allows an effective adjustment of a driving energy for a given propellant charge.

BRIEF SUMMARY OF THE INVENTION

This problem is solved for a driving tool of the type mentioned above by the characterizing features of Claim 1. By providing two control elements for selectively opening the blow-out channel on the one hand and for adjusting the starting position of the piston member on the other, the driving energy can be reduced in a simple manner within a large range.

A blow-out channel in keeping with the invention is understood to mean a channel by means of which the combustion gases from the propellant charge can be diverted into the surroundings or into some other large volume, such as a gas storage unit for returning a piston. Depending on the cross section of the blow-out channel, this makes it possible to achieve a particularly large and fast pressure drop of the combustion chamber.

Alternatively or in addition to the effect of the blow-out channel, a reduction of the driving energy can also be accomplished by the possibility of adjustably varying the starting position of the piston member by means of the second control element. The piston member is moved forward in relation to a rearmost position in a defined manner by the same slide that controls the blow-out channel. In a position shifted forward in this manner, the position of the piston member creates a larger starting volume of the combustion than in a rearmost position of the piston member. The forward shift also reduces the remaining acceleration path of the piston member.

A driving energy in keeping with the invention is understood to mean the kinetic energy of the piston member striking a given fastening means for a given propellant charge. If the boundary conditions are specified, the control element makes it possible to adjustably vary the resulting driving energy for the fastening means.

A piston member in keeping with the invention is any means to which kinetic energy is applied by the ignition of the charge, wherein the kinetic energy is ultimately transmitted to the fastening means. In particular, the piston member is frequently designed as a cylindrical piston. Recesses or other structures that further promote turbulence and uniform expansion of the combustion gases can be provided in the piston base.

A fastening element in keeping with the invention is understood to mean in general any drivable anchoring means such as a nail, a bolt or a screw.

A central axis in keeping with the invention is an axis running through a center of the combustion chamber and at least parallel in relation to the movement of the fastening element.

In a generally preferred embodiment of the invention, the slide is movable parallel to the axis, whereby a simple and effective mechanical implementation becomes possible. In an alternative embodiment of the invention, the slide is movable transversely to the axis, preferably perpendicular to the axis. An outlet cross section of the blow-out channel is preferably variably adjustable continuously or stepwise, depending on the position of the slide.

In a driving tool according to the invention, it is generally advantageous to provide that the exposure of the blow-out channel and the starting position of the piston member can be adjusted independently of one another. In this way, any desired combination of the energy-reducing effects of the control elements can be made, so that a good accuracy of the adjustment over a particularly wide range of driving energy is available.

In a first possible variant of the independent adjustment of the control elements, it can be done completely manually by an operator. For example, one of the control elements can have a separate adjusting wheel or other operating means.

In a second possible variant, the control elements can be linked mechanically, via a slotted guide, for example, a gear mechanism, a linkage rod or the like.

This can provide a functionally linked adjustment of the two control elements by only one operating means, which can mean a simplification for the operator.

In a third possible variant, the control elements can be adjusted via electrically operated actuators. This can precisely adjust the energy by means of an electronic tool controller, depending on sensor signals, for example. In such a variant, for example, desired combinations of positions of the two control elements can be stored in a characteristic diagram.

Any desired different implementations of the adjustment of the separate control elements are possible, for example by varying only one of the control elements using an electrical actuator and manually adjusting the other control element.

For easy mechanical implementation of a driving tool according to the invention, the second control element can comprise an adjustable stop part, wherein the starting position of the piston member is defined by contact of the piston member with the stop part. In particular, the piston member can be movable in the course of an automatic or manually initiated return process until it contacts the stop part. In one possible embodiment, the stop part can be designed as a rod that protrudes into the combustion chamber and strikes against the base of the piston member. In other embodiments, the stop part can also act against a stop on the piston member that is formed outside of the combustion chamber.

In a generally advantageous embodiment of the invention, the combustion chamber is subdivided by a separating member having a plurality of openings into a first partial chamber joining the propellant charge and at least one second partial chamber adjoining the piston member, wherein an ejection region extending between the propellant charge and a central region of the separating member is provided for the propellant charge in the first partial chamber. The ejection region preferably encloses the central axis, i.e. the central axis runs through the ejection region.

It is especially preferred if the ejection region is limited at the central region of the separate member by a contiguous surface of the separating member. By providing the contiguous surface in the central region of the separating member, particles of the charge that are ejected after ignition into the combustion chamber initially are reflected or diverted irrespective of their size before they come into contact with one of the openings. On this modified path, the particles can then distribute themselves uniformly in the upper partial chamber while they are caught by a flame front and likewise ignited.

Overall this guarantees a good and optimally complete combustion of the propellant charge. This applies particularly if the driving energy is adjusted by the control element to a low value and therefore large additional volumes and or blow-out openings affect the combustion process of the propellant charge.

An ejection region in keeping with the invention is a prismatic, normally cylindrical three-dimensional region, the cross section of which is defined by a surface of the igniting charge facing the combustion chamber, and which extends perpendicular to the surface. If the propellant charge is provided in the form of a cartridge, then the surface of the charge is defined as the exit area of the opened cartridge. In this case, the ejection region is substantially cylindrical in shape. The diameter thereof corresponds to the inside diameter of the cartridge support at the exit thereof in the direction of the piston member.

The central axis in keeping with the invention runs as a center of gravity line through the ejection region. Generally, but not necessarily, the central axis coincides with a movement axis of the piston member.

A separating member in keeping with the invention is any structure by which the combustion chamber is divided into two partial chambers. The separating member preferably runs perpendicular to the central axis. It can be formed by a disk in which multiple bore holes have been formed.

The central region of the separating member is preferably not perforated, so that at least a substantial part of the initially ejected particles move within the ejection region through the combustion chamber against the central region without first entering the second partial chamber through the separating member.

The contiguous surface area of the central region is preferably larger than a plane of intersection of the separating member with the ejection region.

In generally preferred embodiments of the invention, the central region of the separating member has a depression. A particularly good back-scattering of the deflected particles and turbulence of the combustion gases in the first partial chamber can be achieved by means of this depression.

In a preferred embodiment, the depression is formed as a bowl-shaped recess in the separating member. This influences scattering and turbulence formation to a particular extent.

For further improvement of scattering and turbulence formation, a projecting protrusion in the central bottom area of the recess is provided in a preferred embodiment. The protrusion can be conical, for example.

Alternatively or additionally, it is provided that the depression has a diameter decreasing downward, which likewise effects a good distribution of powder grains and combustion gases.

In the interest of an optimal effect of the depression on a large part of the propellant charge, it is preferable that a maximum diameter of the depression extending perpendicular to the central axis is not less than 80% of a maximum diameter of the opening for the propellant charge. It is especially preferred if the diameter of the depression is greater then the diameter of the opening for the propellant charge.

Likewise in the interest of improving the turbulence-forming effect of the depression, it is preferable that a maximum depth of the depression measured in the direction of the axis is not less than 30% and especially preferably not less than 50% of the maximum diameter of the depression, measured perpendicular to the axis.

It is generally advantageous to provide a ridge between each two adjacent perforations, with combustion gases from the propellant charge first flowing radially outward between the ridges before flowing in the axial direction through the perforations after a deflection. This further optimizes the deflection and turbulence of the combustion gases, and prevents an undesired entry of large powder grains into the perforations.

It can be generally preferred that the perforations of the separating member have a cross section that is larger than a maximum cross section of particles from the explosion charge. This prevents clogging of the perforations with combustion residues. Due to the other features of the invention, entry of large powder grains into the second partial chamber is largely prevented, despite relatively large perforations.

In the interests of simple installation and maintenance, the separating member is preferably screwed into the combustion chamber by means of an external thread formed on the separating member.

In a generally preferred embodiment of the invention, it is preferred that a maximum driving energy that can be adjusted by means of the control element during ordinary operation and with an unchanged propellant charge corresponds to at least twice a minimum driving energy adjustable by means of the control element. The maximum driving energy is preferably at least 2.5 times the minimum driving energy. In an advantageous detail design, the minimum driving energy is not more than 150 joules and the maximum energy not less than 250 joules. This can enable a particularly universal usage of the driving tool, without having to provide a large number of propellant charges of different power depending on the application case.

In general, a driving energy can be adjusted at least partially automatically by means of an electronic tool controller. The necessary specifications, such as the type and dimensioning of the workpiece, can be provided by an operator. Sensor information, regarding the type of fastening means that has been loaded for example, can be used alternatively or additionally.

For a system for driving a fastening element into a workpiece, the problem addressed by the invention is solved by the features of Claim 14. A driving tool according to the invention makes it possible to cover a wide range of driving energies with only one propellant charge. It is accordingly unnecessary to offer other propellant charges for operating the tool.

Further features and advantages of the invention follow from the embodiments described below, and from the dependent claims. Several preferred embodiments of the invention will be described below and explained in detail with reference to the attached drawings.

BRIEF DESCRIPTION OF THE SEVERAL VIEWS OF THE DRAWING(S)

DETAILED DESCRIPTION OF THE INVENTION

Figure 1:
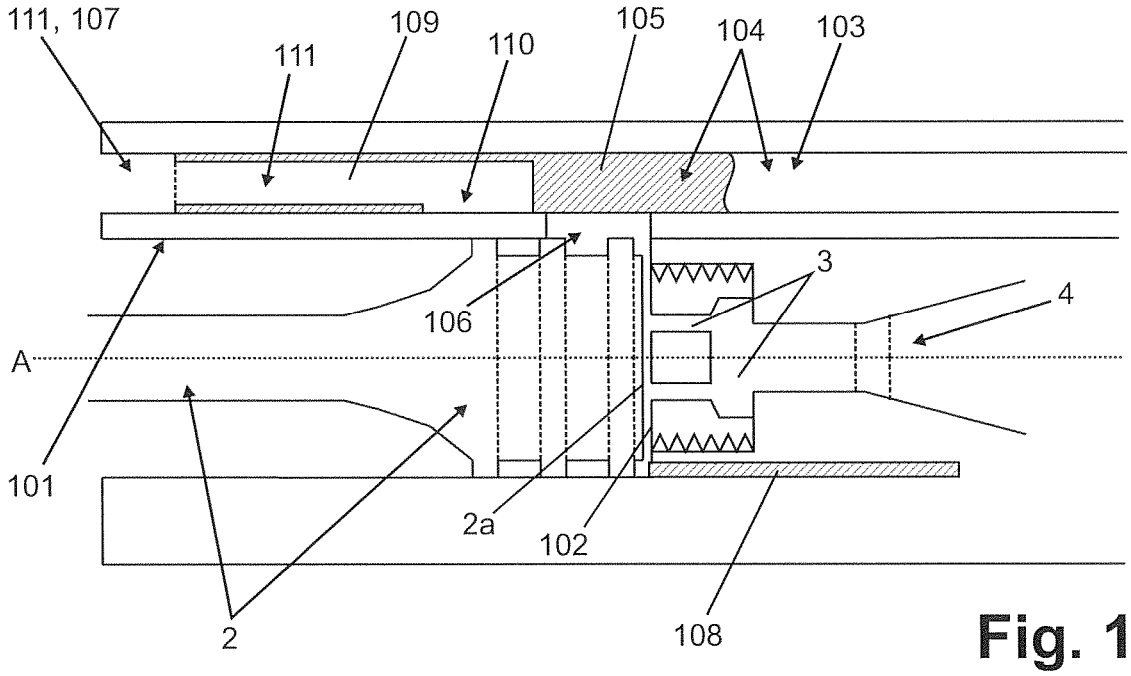
FIG. 1 shows a partial sectional view of a combustion chamber for a driving tool according to the invention at maximum driving energy.

A driving tool according to the invention comprises a handheld housing in which a piston member in the form of a piston 2 is accommodated. A surface 2*a* of the piston 2 delimits a combustion chamber 3, in which the combustion gases of a pyrotechnic charge expand in order to accelerate the piston 2. The pyrotechnic charge is solid, preferably in the form of powder. In examples that are not shown, the pyrotechnic charge is liquid or gaseous.

The piston 2 to which kinetic energy has been applied in this manner strikes with its piston shaft against a fastening element, which is thereby driven into a workpiece.

The charge is held in the present case in a cartridge made of sheet metal. The cartridge has a percussion igniter and is inserted before ignition into a cartridge support 4 via an appropriate loading mechanism.

The cartridge and the cartridge support are preferably formed so as to be rotationally symmetrical about a central axis A. The central axis A in the present examples is simultaneously a center axis of the combustion chamber 3 and the piston 2.

The combustion chamber 3 is arranged between a cylindrical opening 4*a* of the cartridge support 4 and the surface 2*a* of the piston 2. In a possible detailed design, an annular depression 2*b* is formed in the piston 2, which contributes to a better turbulence formation in the combustion gases and constitutes a part of the combustion chamber 3.

The combustion chamber 3 in the present case has a side wall 101, which is formed as a rotational surface of a parallel line about the central axis A, i.e. as an internal cylinder. The combustion chamber 3 additionally has a base surface 102, which extends substantially perpendicular to the axis A.

Two control elements 104, 108 are provided for adjustably varying the kinetic energy absorbed by the piston member 2 for a given propellant charge, and thus for adjustably varying a driving energy for the fastening means.

Figure 2:
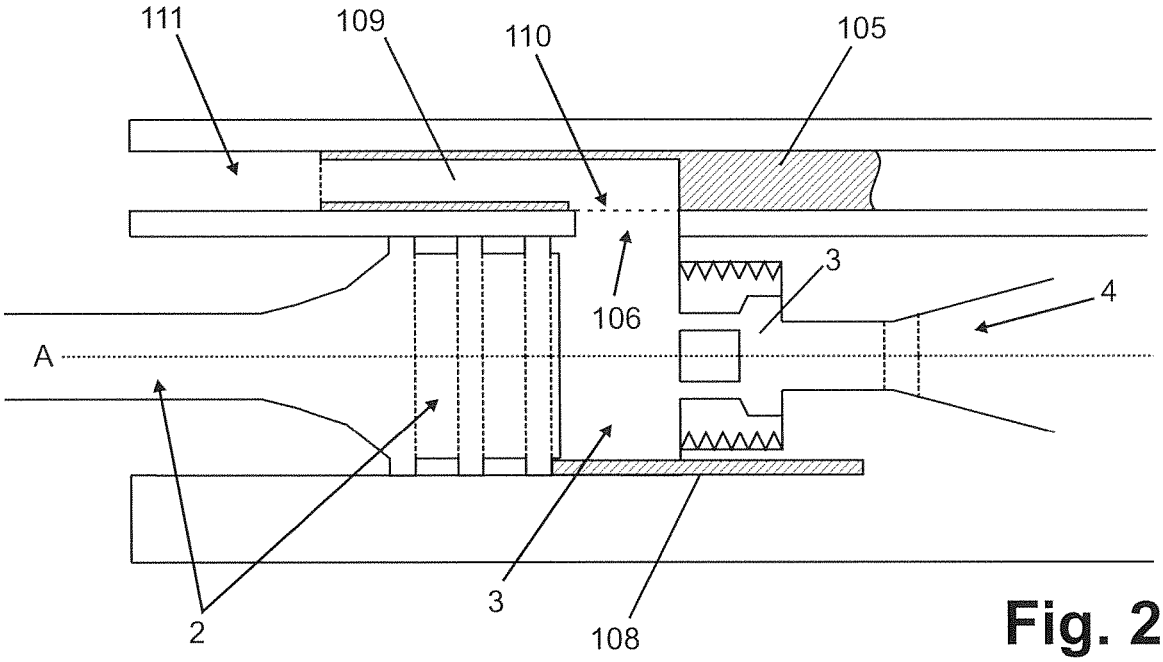
FIG. 2 shows the driving tool from FIG. 1 with a completely opened slide and with the starting position of the piston member shifted forward.
Figure 3:
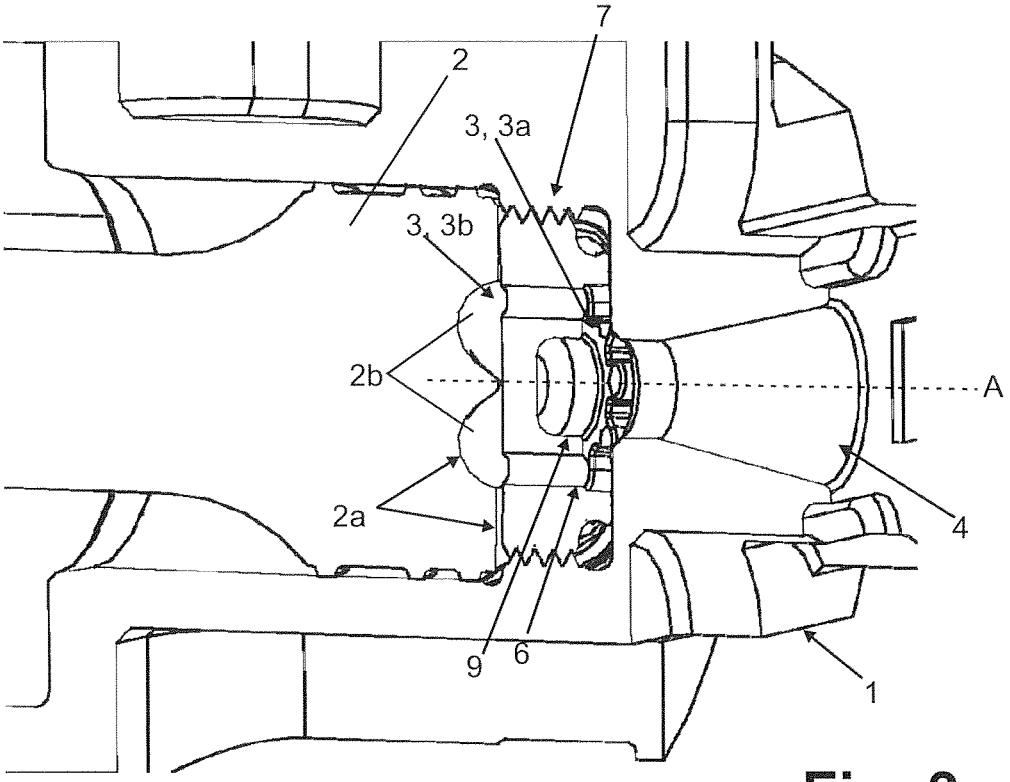
FIG. 3 shows a three-dimensional sectional view of a combustion chamber of a driving tool having a separating member.
Figure 4:
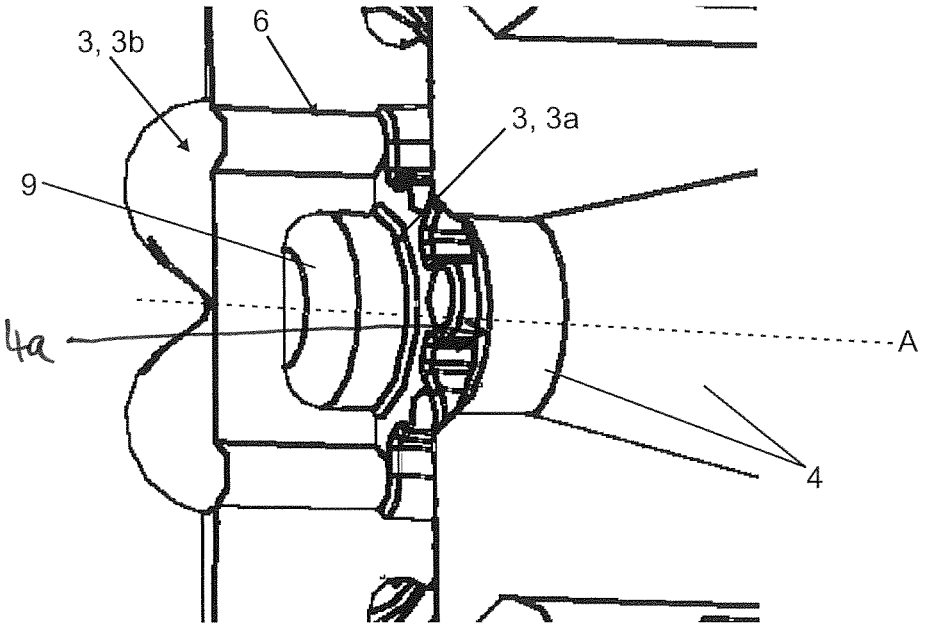
FIG. 4 shows a three-dimensional detail view of the combustion chamber from FIG. 3.
Figure 5:
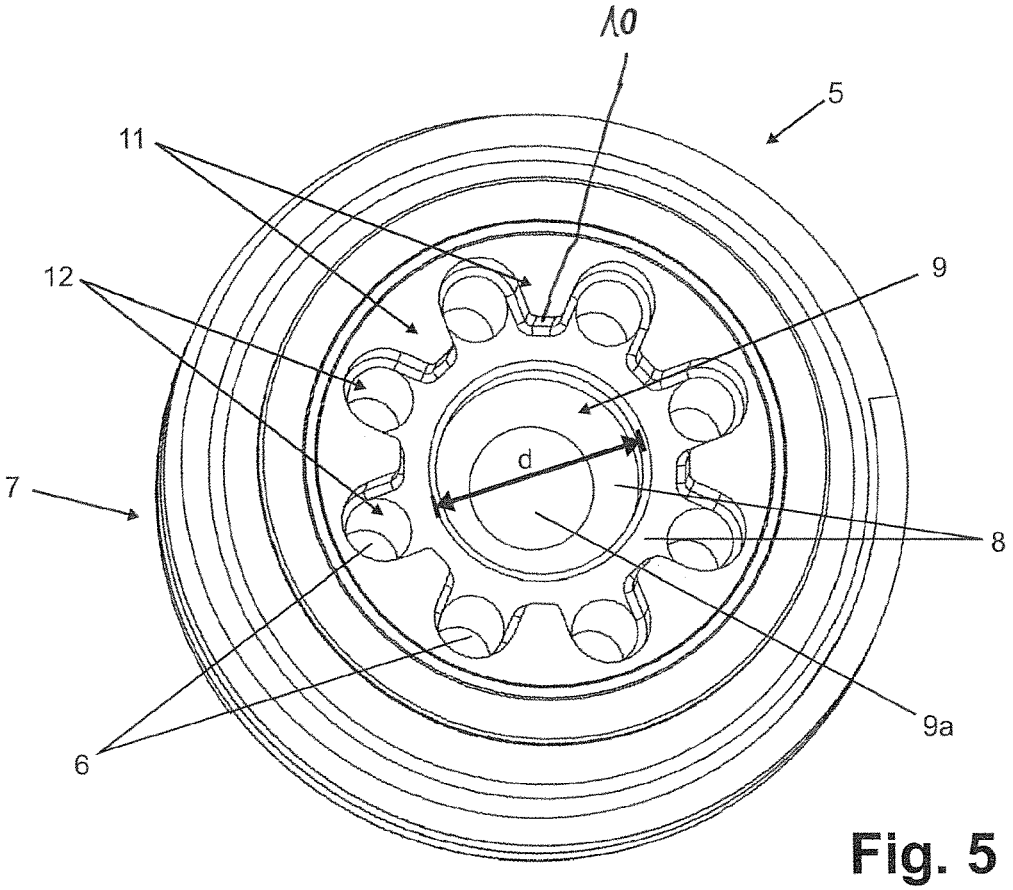
FIG. 5 shows a three-dimensional view of a separating member of the combustion chamber from FIG. 3.

The first control element 104 comprises a recess 103 that is parallel to the combustion chamber and guides a slide 105. The control element 104 also comprises a mechanism (not shown) for displacing a position of the slide 105. The slide is shown in FIGS. 1 and 2 with crosshatching for better understanding.

The slide 105 is accommodated in the recess 103 in a housing enclosing the combustion chamber. In this recess, the slide 103 is adjustable in position parallel to the central axis A. For this purpose, an external thread (not shown) can be formed on the rear end of the slider 105, for example. The external thread can then run in an internal thread of a rotatably mounted gear supported in the axial direction. If the gear is driven, the slide 105 can be displaced in the axial direction by the rotation of the thread. The mechanism displacing the slide 105 can be designed as desired.

Depending on the requirements, the slide can be displaced manually, by an adjustment wheel, not shown, for example. The displacement can also involve an electrical actuator, however. An at least partially automatic adjustment of the driving energy can be accomplished by an electronic tool controller. The necessary specifications, such as the type and dimensioning of the workpiece, can be provided by an operator. Sensor information, regarding the type of fastening means that has been loaded for example, can be used alternatively or additionally.

The recess 103 is connected via an opening 106 to the combustion chamber 3. A channel 107 parallel to the combustion chamber leads to the front in the driving direction.

The slide 105 fills up the recess 103 and additionally has an axially extending bore 109 open at the front and having a lateral opening 110 that is oriented in the direction of the perforation 106.

Depending on the position of the slide 105, the lateral opening 110 does not cover the perforation 106 at all, covers it partially or covers it completely. In this way, the volume of the combustion chamber 3 can be connected via an adjustably variable cross section to the bore 109 and the channel 107.

If the slider is in an appropriate position, the opening 110, the bore 109 and the channel 107 together form a blow-out channel 111. After an ignition of the pyrotechnic propellant charge, expanding gases can escape partly into the blow-out channel, depending on the opening status thereof. This reduces the kinetic energy or driving energy that is ultimately absorbed by the piston member 2.

The blow-out channel 111 in the present case opens into a gas channel, not shown, at a guide for the piston member 2 located in front of the combustion chamber 3. The channel ends in a known manner in a storage chamber (not shown). At the end of the driving process, the piston member 2 is moved back into the initial position in a known manner by means of the combustion gases collected in the storage chamber. In alternative embodiments, the blow-out channel 111 can also open directly into the atmosphere.

A second control element for varying the driving energy is designed as an adjustable stop part 108. A starting position of the piston member 2 is variably defined in this case by the stop for the piston member 2 on the stop part 108.

In the present case, the stop part is formed as a rod 108 penetrating into the combustion chamber 3. The rod can be moved in the axial direction by a mechanism, not shown. In particular, analogously to a possible displacement of the slide 105, a thread and an operating part such as an adjusting wheel can be provided for displacing the rod 108.

In the maximal energy position according to FIG. 1, a base surface 2*a* of the piston member 2 contacts the base surface 102 of the combustion chamber 3 in the initial state of the piston member 2. This implies a maximum acceleration path of the piston and a minimal starting volume of the combustion chamber at the charge ignition time. Since the blow-out channel 111 is also completely closed, a maximum driving energy is achieved.

If the rod 108 is displaced from the position shown in FIG. 1 into the combustion chamber, the starting position or initial position of the piston member 2 is shifted forward, see FIG. 2. This leads to a larger combustion chamber volume and a smaller acceleration path of the piston member 2.

If necessary, a pressure buildup in the combustion chamber 3 is further reduced by partial or complete opening of the blow-out channel 111; see the opened position of the slide 105 in FIG. 2. The driving energy achieved by the piston member 2 is reduced overall in this way. In the positions of the slide 105 and the second control element 108 according to FIG. 2, there is a maximally opened blow-out channel 111 and a maximum shift forward of the piston member 2. This achieves the smallest possible value for the driving energy with a given propellant charge.

The two control elements 104, 108 can be adjusted entirely independently of one another, so that the reduction of driving energy achieved results as an overlapping of the two respective effects.

It should be noted with regard to the slide 105 of the first control element that the opened position in the present case is achieved by shifting the slide to the rear. A front part of the perforation 106 is first exposed. In a partially open position, this has a different effect on the driving energy than if initially an equally large rear part of the opening 106 were exposed. Depending on the requirements, the slide can also be adjusted in this way, so that overall even more precise optimizations of the combustion process and the driving energy are available.

With regard to the rod or the stop part of the second control element 108, it should be noted that it can be retracted out of the combustion chamber if needed, before an ignition of the propellant charge, after the starting position of the piston member 2 has been previously set stopping the piston bottom.

The discussion below relates to optimized designs of the combustion chamber in the driving tool by means of the separating member. Although no control element for varying the driving energy is shown in the drawings of FIGS. 3-8, the designs of the combustion chamber with a separating member can be combined with the above described designs of a control element 104, depending on the requirements.

The combustion chamber 3 is subdivided transversely to the central axis A by a separating member 5. A first partial chamber 3*a* of the combustion chamber is situated on the side of the cartridge support 4, and a second partial chamber 3*b* of the combustion chamber 3 is situated on the side of the piston 2.

In the drawings of FIGS. 3-8, the piston is maximally retracted, so that the second partial chamber 3*b* includes only the depression 2*b* and possibly a narrow gap between the piston 2 and separating member 5 at the time of ignition.

The separating member 5 in the present case is formed as a component that can be screwed into the combustion chamber 3 by means of an external thread 7. The separating member can also be integrally formed with the remainder of the combustion chamber or connected in some other way as a separate component to the combustion chamber.

The separating member 5 has a plurality of perforations 6, which are constructed in the present case as bores that run parallel to the axis A. The perforations 6 are arranged about a central region 8 of the separating member 5 that has a contiguous and non-perforated surface. The smallest diameter of the central, non-perforated region 8 in the plane perpendicular to the axis A is approximately 35% smaller than the diameter of the cartridge when opened after ignition. In this case, this region corresponds approximately to the diameter of an opening of the cartridge support on the combustion chamber side or of a surface of the pyrotechnic charge directed into the combustion chamber.

It is currently assumed that the combustion gases and powder grains, charge particles or the like that are ejected along with them initially travel parallel to the central axis into the combustion chamber. At least directly after ignition and over a certain length, the expanding charge therefore moves predominantly along the axis in a prismatic ejection region, the outline of which is defined by the surface of the charge. In the present embodiments of the invention, all the perforations 6 of the separating member are outside an intersection surface of the ejection region with the surface of the separating member. Corresponding to the circular cartridge opening, the ejection region is formed as a cylinder.

A depression 9 is also formed in the central region 8 of the separating member 5. The depression 9 runs rotationally symmetrically about the central axis A. It has a bowl shape and a flat bottom 9*a*. The diameter of the depression 9 tapers from a largest diameter d at the upper edge thereof to a smallest diameter at the level of the bottom 9*a*. The walls of the depression 9 have both inclined and straight portions. The maximum depth of the depression 9 in this case is approximately 60% of the largest diameter d.

In the plane of the upper edge of the depression 9, the closed surface of the central region 8 extends up to a gradation 10. This gradation 10 rises in the axial direction from the surface of the central region 8 to a roof of the combustion chamber 3. The separating member 5 is pressed with the gradation 10 against the roof in the present case. This is achieved by screwing the separating member 5 into the combustion chamber 3 appropriately.

The gradation 10 forms respective inwardly-directed ridges 11 between adjacent perforations 6. Accordingly, radially directed channels 12 remain between the ridges 11, through which the combustion gases and particles of the charge initially flow radially outward from the central region 8 and then are deflected into the perforations 6.

The invention operates in relation to the separating member as follows:

After ignition of the cartridge, as yet non-combusted particles are accelerated ahead of a front of combustion gases through the interior cartridge opening into the first partial chamber 3*a*. After a short travel, this partially non-combusted part of the charge strikes the bowl-shaped depression 9 of the contiguous central region 8 of the separating member 5. The powder grains and combustion gases are scattered and become turbulent there, and the powder grains continue to ignite and burn. This reacting and expanding mixture passes in a predominantly radial direction between the ridges 11 and is deflected into the perforations 6.

When passing through the perforations 6, the particles of the charge have already predominantly combusted, so that large non-combusted charge residues do not remain in the perforations or in the downstream second partial chamber 3*b*. This prevents unfavorable deposits and/or clogging of the perforations 6. At the same time, a controlled and uniform expansion of the combustion gases in the second partial chamber is favored, so that the piston 2 is optimally accelerated.

Figure 6:
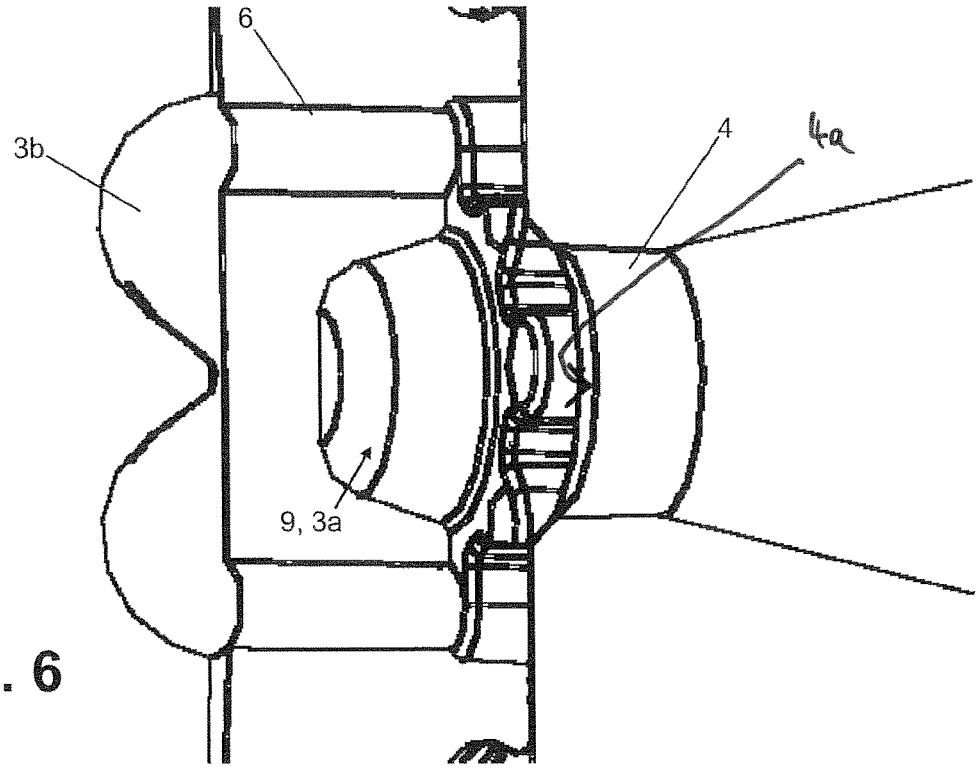
FIG. 6 shows a three-dimensional view of a combustion chamber having a second embodiment of a separating member.

In the second example of a separating member, which is shown in FIG. 6, the depression 9 is shaped differently. As in the first example, the depression is constructed as a bowl-like recess, but the walls of the depression are more sharply and continuously inclined.

Figure 7:
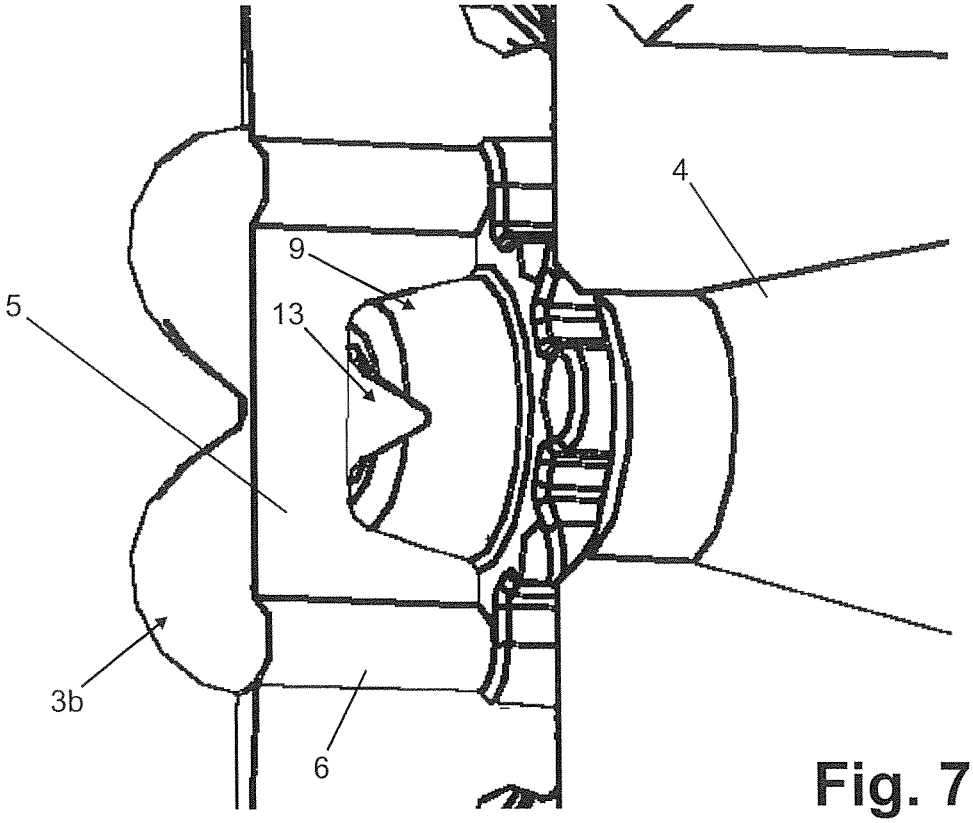
FIG. 7 shows a three-dimensional view of a combustion chamber having a third embodiment of a separating member.

In the embodiment of a separating member shown in FIG. 7, the shaping of the depression 9 is largely as in the example of FIG. 6. In addition, a projecting conical protrusion 13 is formed above the bottom of the depression. The conical protrusion 13 causes a significant scattering and turbulence of the combustion gases.

Figure 8:
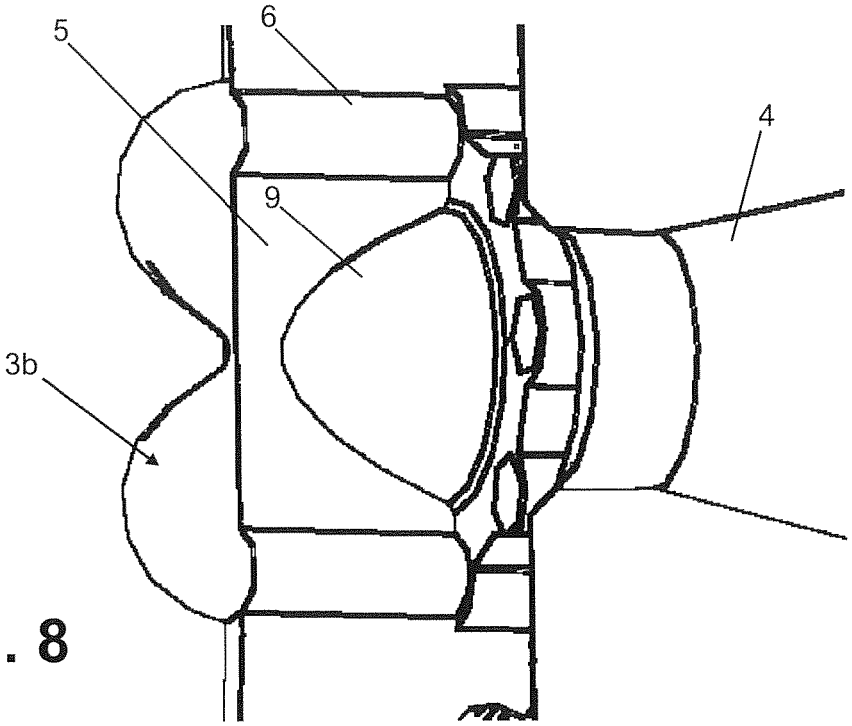
FIG. 8 shows a three-dimensional view of a combustion chamber having a fourth embodiment of a separating member.

In the embodiment of a separating member shown in FIG. 8, the depression 9 does not have a flat bottom but rather a predominantly parabolic cross section overall. Such a shape is particularly well-suited to avoid deposits.

It is understood that the invention is not limited to the shapes of the depression 9 that are shown for the sake of example.

As a whole, a system for driving a fastening element into a workpiece is provided by a driving tool as described above, in conjunction with a propellant charge and a selection of fastening means. The system comprises a plurality of different fastening means, and only one type of propellant charge is necessary to cover a complete range of driving energies.

The driving energy transmitted to the piston member extends from a minimum driving energy of 90 joules to a maximum driving energy of 325 joules, using the same propellant charge.

The invention claimed is:

1. A driving tool, comprising a handheld housing, having a piston member accommodated therein for transmitting energy to a fastening element to be driven in, the piston member having a starting position; a propellant charge;

a combustion chamber arranged between the propellant charge and the piston member, extending about a central axis (A);

a first control element, for variably adjusting energy transmitted from the propellant charge to the piston member, the first control element comprising a movable slide, wherein moving the slide exposes a blow-out channel connected to the combustion chamber;

and, a second control element for variably adjusting the starting position of the piston member, wherein the first and second control elements are linked to each other.

2. The driving tool according to claim 1, wherein the slide is movable parallel to the axis (A).

3. The driving tool according to claim 2, wherein the blow-out channel has an exit cross-section that is variably adjustable according to the position of the slide.

4. The driving tool according to claim 2, wherein the second control element comprises an adjustable stop part, wherein the starting position of the piston member is defined by contact of the piston member with the stop part.

5. The driving tool according to claim 1, wherein the second control element comprises an adjustable stop part, wherein the starting position of the piston member is defined by contact of the piston member with the adjustable stop part.

6. The driving tool according to claim 1, wherein the combustion chamber is subdivided by a separating member having a plurality of perforations and a central region, into a first partial chamber adjoining the propellant charge and at least one second partial chamber adjoining the piston member, and wherein an ejection region for the propellant charge is provided in the first partial chamber, the ejection region extending between the propellant charge and the central region of the separating member.

7. The driving tool according to claim 6, wherein the ejection region is bounded at the central region of the separating member by a non-perforated surface of the separating member.

8. The driving tool according to claim 6, wherein the central region of the separating member has a depression.

9. The driving tool according to claim 1, wherein a maximum driving energy that can be adjusted by the first control element during ordinary operation corresponds, for an unchanged propellant charge, to at least twice a minimum driving energy adjustable by the first control element.

10. The driving tool according to claim 9, wherein the minimum driving energy is not more than 150 joules and the maximum driving energy is not less than 250 joules.

11. The driving tool according to claim 1, wherein the blow-out channel has an outlet cross-section that is variably adjustable according to the position of the slide.

12. The driving tool according to claim 1, wherein the second control element comprises an adjustable stop part, wherein the starting position of the piston member is defined by contact of the piston member with the stop part.

13. The driving tool according to claim 1, wherein the first and second control elements are linked to each other by a mechanical linkage.

14. The driving tool according to claim 13, wherein the first and second control elements are linked to each other by a slotted guide.

15. The driving tool according to claim 13, wherein the first and second control elements are linked to each other by a gear mechanism.

16. The driving tool according to claim 13, wherein the first and second control elements are linked to each other by a linkage rod.

17. The driving tool according to claim 1, wherein the first and second control elements are linked to each other by a only one operating member.

18. The driving tool according to claim 1, wherein the first and second control elements are adjusted via electrically operated actuators.

19. A system for driving a fastening element into a workpiece, comprising a driving tool comprising a handheld housing, having a piston member accommodated therein for transmitting energy to a fastening element to be driven in, the piston member having a starting position; a propellant charge; a combustion chamber arranged between the propellant charge and the piston member, extending about a central axis (A); a first control element, for variably adjusting energy transmitted from the propellant charge to the piston member, the first control element comprising a movable slide, wherein moving the slide exposes a blow-out channel connected to the combustion chamber; and, a second control element for variably adjusting the starting position of the piston member, wherein the first and second control elements are linked to each other; and a plurality of different fastening elements, wherein the system comprises only propellant charges with essentially identical propellant charge energy for covering a complete range of driving energies.

* * * * *